US007484996B2

(12) United States Patent
Ju

(10) Patent No.: US 7,484,996 B2
(45) Date of Patent: Feb. 3, 2009

(54) ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/544,708

(22) Filed: Oct. 10, 2006

(65) Prior Publication Data

US 2008/0085613 A1 Apr. 10, 2008

(51) Int. Cl.
*H01R 13/60* (2006.01)

(52) U.S. Cl. ..... 439/541.5

(58) Field of Classification Search ..... 439/13, 439/607–610, 541.5, 101, 654, 440, 105, 439/107, 606, 76.1, 79, 874, 83, 630, 90, 439/170, 222

See application file for complete search history.

(56) References Cited

U.S. PATENT DOCUMENTS 6,921,291 B2 * 7/2005 Shih ..... 439/541.5
7,029,329 B1 * 4/2006 Huang ..... 439/607
7,192,198 B1 * 3/2007 Chen et al. ..... 385/76

* cited by examiner

*Primary Examiner*—Edwin A. Leon
(74) *Attorney, Agent, or Firm*—Birch, Stewart, Kolasch & Birch, LLP

(57) ABSTRACT

The present invention provides an electrical connector which includes an insulative body and a plurality of terminals. In addition, the insulative body has at least a receiving hole for the insertion of an electrical device, and each receiving hole has a plurality of terminals. Moreover, the plurality of terminals has a horizontal portion and a vertical portion perpendicular to one another; the horizontal portion has a contact portion, and the bottom of the vertical portion has a conductive portion. Furthermore, the insulative body has a fixing portion protruding from an end opposite to the receiving hole, and the fixing portion has a positioning structure for locating the vertical portion of the terminal, and the electrical connector has a base for mate with the positioning structure to fix the terminals in the positioning structure.

7 Claims, 5 Drawing Sheets

ELECTRICAL CONNECTOR

BACKGROUND OF THE INVENTION

1. Field of the Invention

The invention relates to an electrical connector, and more particularly, to an audio jack electrical connector.

2. Description of the Prior Art

With the development of electrical products and multimedia personal computers, audio jack electrical connector has been widely applied in many fields as mentioned above. Furthermore, with the expanding requirements of peripheral components of many electrical products, the requirement of the functions and stability of the audio jack electrical connector is also getting higher than before.

Please refer to Chinese patent No. 200420121039.0 for the prior art, the electrical connector of the prior art includes an insulative body, a metal housing outside the insulative body, terminals, part of which is contained within the insulative body, and a base for mating with the insulative body to fix the positions of terminals. Furthermore, the insulative body has a receiving hole for connecting with exterior elements; part of the terminal is contained in the receiving hole, and part of which is curved and extended downwardly through the passageway of the base and protruded from the bottom surface of the base, and it is then soldered to a welding point on the circuit board. Moreover, the end portion of the terminal is fixed in the base for mounting the terminal. However, part of the terminal showed between the insulative body and the base is longer than the other parts of the terminal; therefore, the terminal can not be positioned effectively and can easily be swayed by forces, thus affecting the stability of the electrical connector.

Accordingly, there is a need to design a new electrical connector to overcome the defects as described above.

SUMMARY OF THE INVENTION

An aspect of the present invention is to provide an electrical connector for effectively fixing terminals therein.

A preferred embodiment of the present invention provides an electrical connector which includes an insulative body and a plurality of terminals. In addition, the insulative body has at least a receiving hole for the insertion of an electrical device, and each the receiving hole has a plurality of terminals. Moreover, each terminal has a horizontal portion and a vertical portion perpendicular to one another; the horizontal portion has a contact portion, and the bottom of the vertical portion is a conductive portion. Furthermore, the insulative body has a fixing portion protruding from between two adjacent receiving holes of an end opposite to the receiving hole, and the fixing portion has a positioning structure for locating the vertical portion of the terminal; the electrical connector has a base for mating with the positioning structure to fix the terminals in the positioning structure.

Compared with the prior art, the electrical connector of the present invention has a fixing portion for positioning the terminals, between adjacent receiving holes of the insulative body, and it also has a base for mating with the positioning structure to firmly fix the terminals in the positioning structure. With the fixing portion, the positioning structure; and the base, the electrical connector of the invention is capable of effectively fixing the terminals therein, thus ensuring the stability thereof.

The scope of the present invention will no doubt become obvious to those of ordinary skill in the art after reading the following detailed description of the preferred embodiment, which is illustrated in the various figures and drawings.

BRIEF DESCRIPTION OF THE APPENDED DRAWINGS

DETAILED DESCRIPTION OF THE INVENTION

Figure 1:
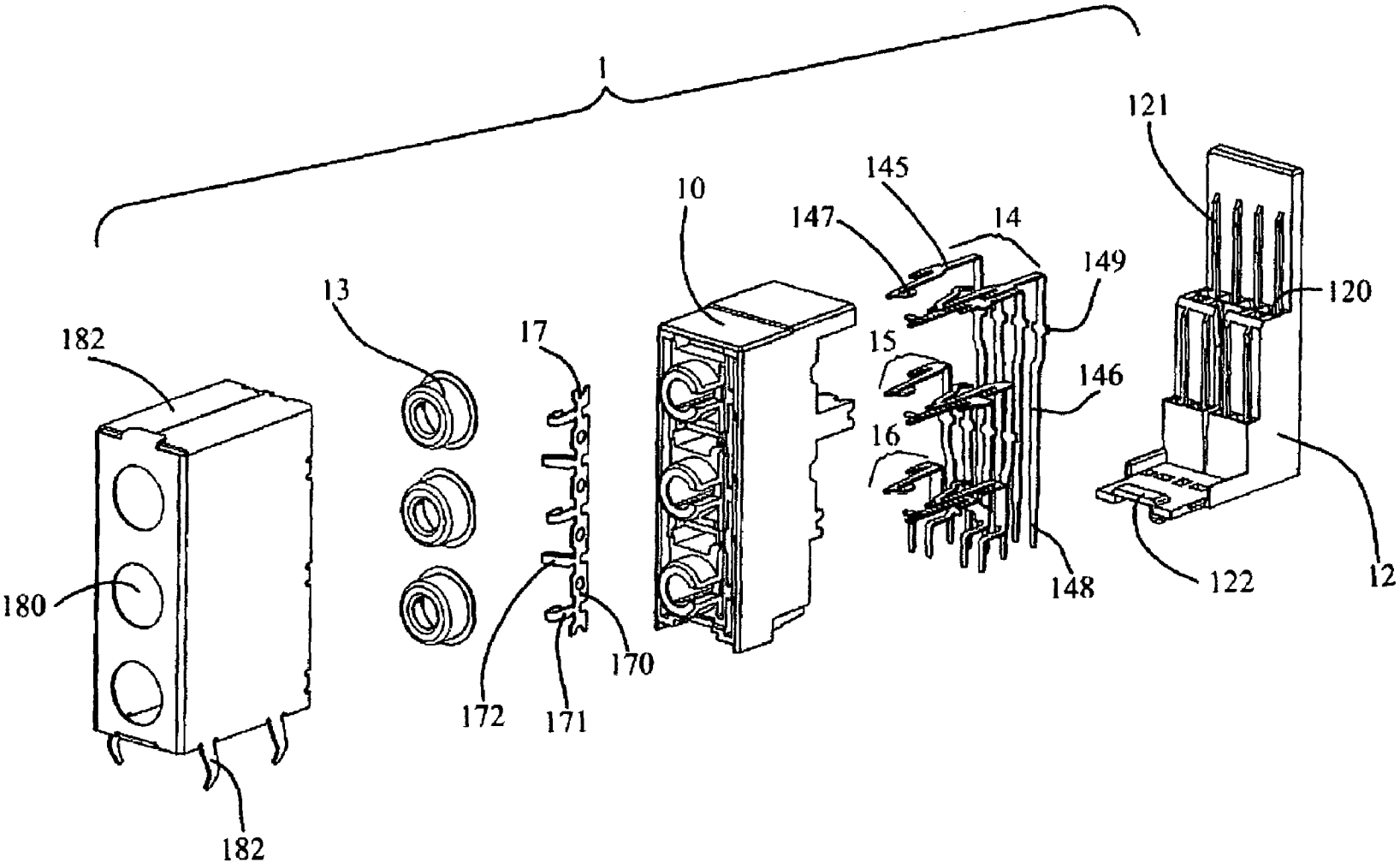
FIG. 1 is an exploded view of the electrical connector of the present invention.
Figure 2:
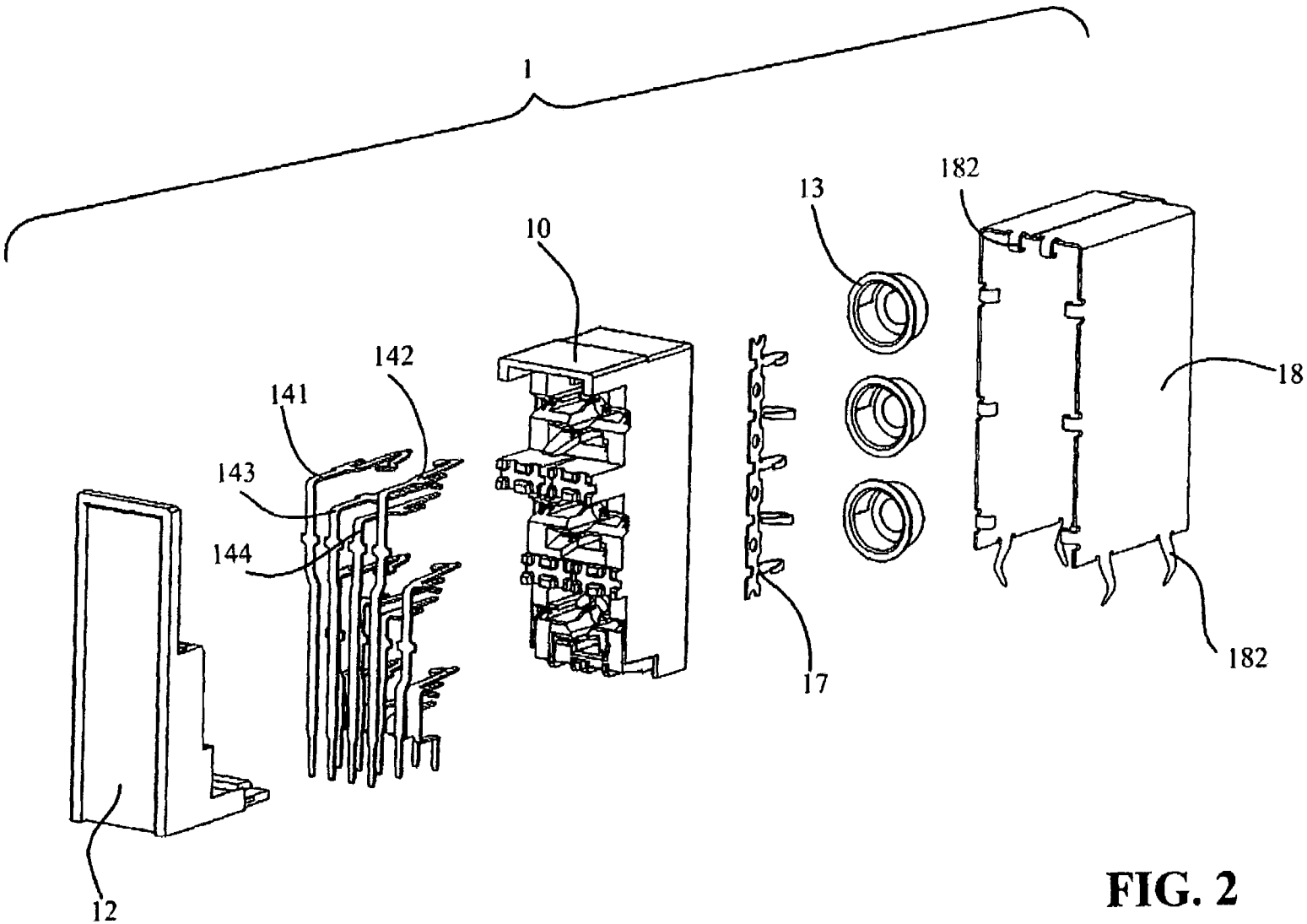
FIG. 2 shows an exploded view of the electrical connector of FIG. 1 from another angle.
Figure 4:
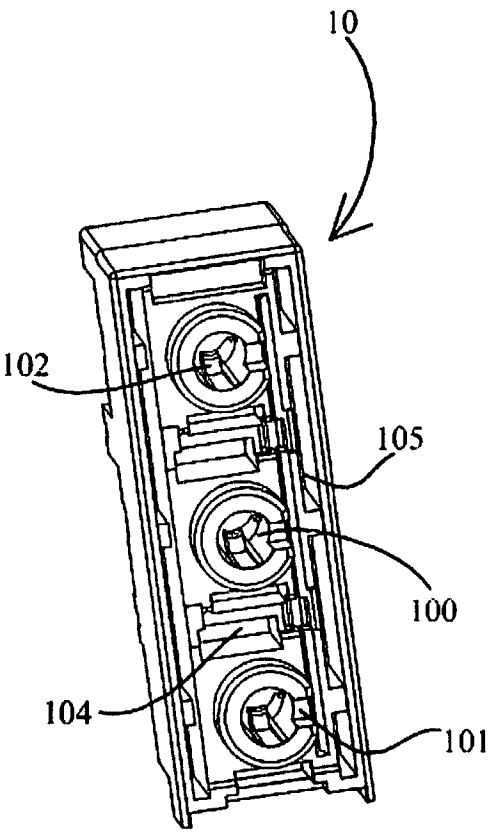
FIG. 4 shows the insulative body of the electrical connector of FIG. 1.
Figure 3:
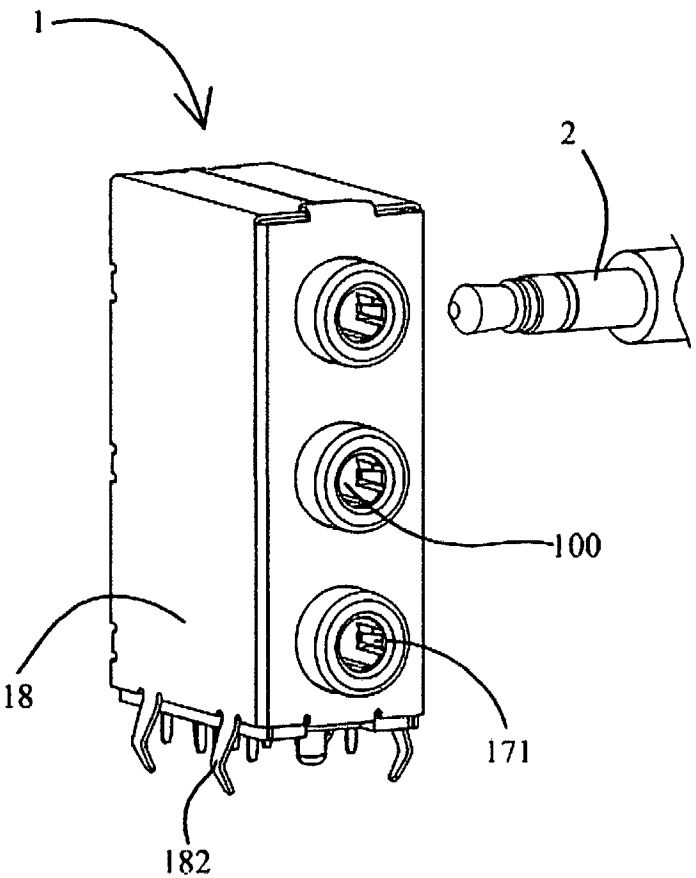
FIG. 3 is an assembled view of the electrical connector of FIG. 1.
Figure 7:
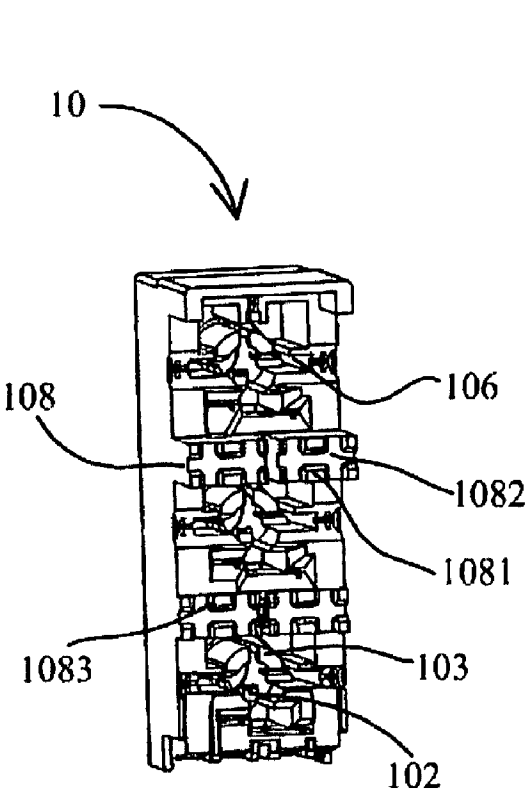
FIG. 7 shows the insulative body of the electrical connector of FIG. 4 from yet another angle.
Figure 6:
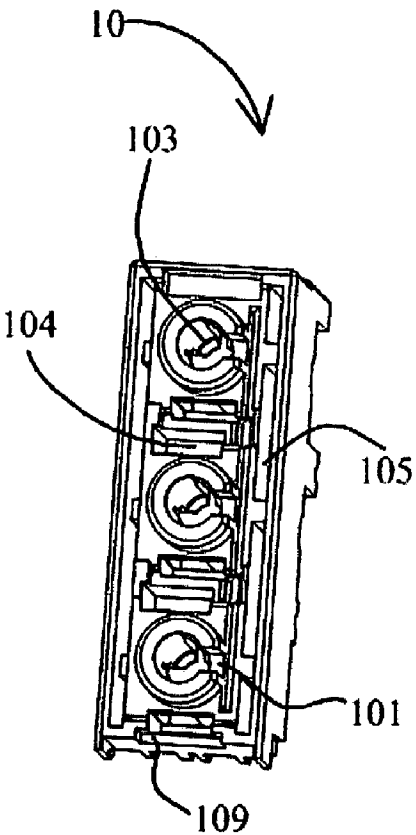
FIG. 6 shows the insulative body of the electrical connector of FIG. 4 from yet another angle.
Figure 5:
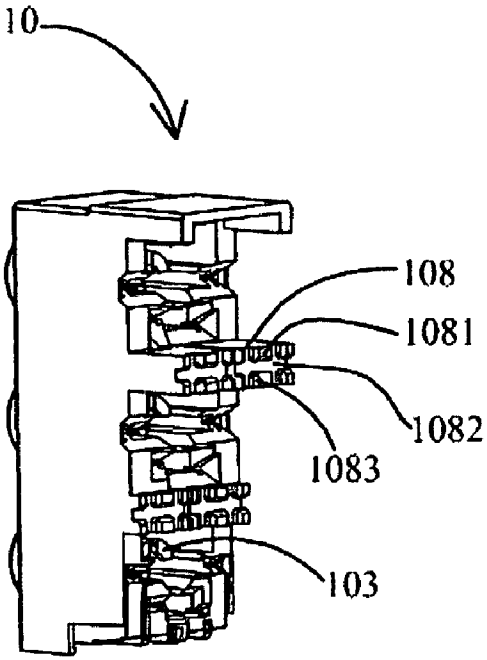
FIG. 5 shows the insulative body of the electrical connector of FIG. 4 from another angle.
Figure 8:
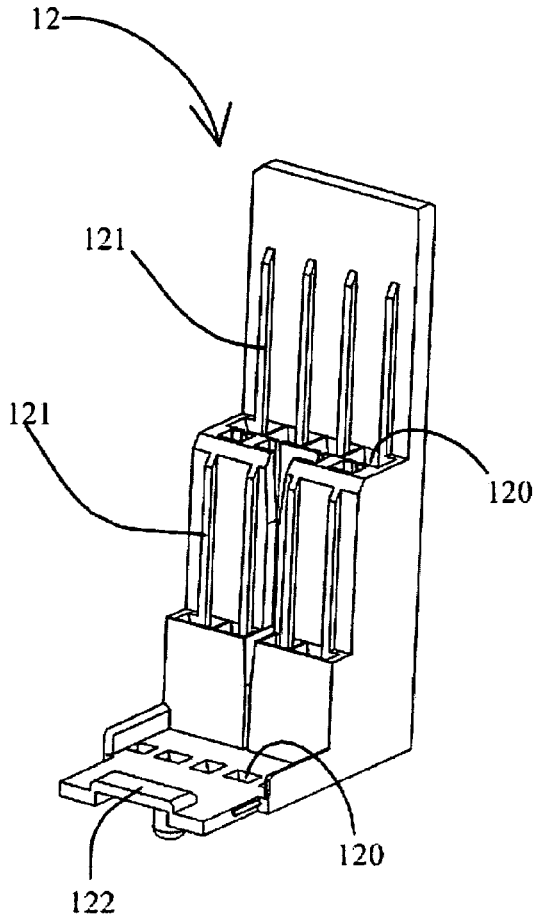
FIG. 8 shows the base of the electrical connector of FIG. 1.

The objective of the present invention is to provide an electrical connector.

Please refer to FIG. 1 to FIG. 8. The electrical connector of the present invention is an audio jack electrical connector 1 for connecting with an external electrical device (e.g. a plug 2) to perform transmission of audio signals. Furthermore, the electrical connector 1 includes an insulative body 10, a base 12, a plurality of mounting rings 13, three sets of terminals 14, 15, 16 arranged in upper, middle, and lower rows in which each row contains four terminals; it also has a ground piece 17 having a plurality of ground terminals, and a shielding shell 18 for covering the external surfaces of the insulative body 10 and the base 12.

Figure 9:
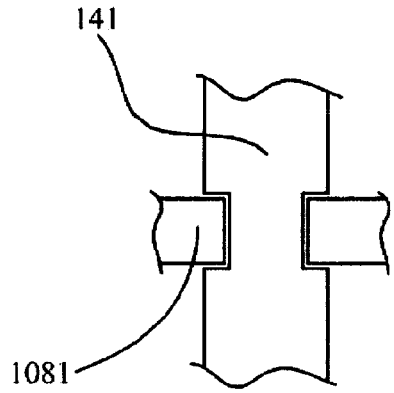
FIG. 9 is a diagram of the second embodiment of the present invention.

Furthermore, the insulative body 10 has receiving holes 100 for insertion of the plug 2, and the receiving holes 100 are arranged respectively in the upper, middle, and lower part of the insulative body 100. Additionally, each receiving hole 100 has a set of terminals, whereas each set of terminal includes four terminals. Furthermore, the four terminals include a first terminal 141 and a second terminal 142, for electrically connecting with the plug 2, and a third terminal 143 and a fourth terminal 144, for electrically connecting each other. Each the terminal includes a horizontal portion 145 and a vertical portion 146 perpendicular to one another, wherein the horizontal portion 145 has a contact portion 147, and the bottom of the vertical portion 146 has a conductive portion 148. In addition, the edge of the side wall of each receiving hole 100 has a breach 101, whereas the bottom of the receiving hole 100 has a plastic arm 102 protruding from the insulative body 10, and the top of the receiving hole 100 has an extruding arm 103 protruding from the insulative body 10. Furthermore, two gaps 104 are disposed at the spaces between each of the three receiving holes 100 at the front of the insulative body 10, whereas a ground piece containing channel 105 was disposed near the receiving holes 100 for containing the ground piece 17. Besides, the back end of the insulative body 10 has three rows of terminal containing channels 106, arranged in upper, middle and lower position, for containing each set of corresponding terminals respectively. At the end opposite to the receiving holes 100 of the insulative body 10, the fixing portion 108 are protrude from two adjacent holes therebetween, wherein the positioning structure is disposed on the fixing portion 108 for positioning the vertical portion of the upper and middle rows of the terminals (because the vertical portion of the lower row of terminals is shorter than the upper and middle one, they are less likely to swing because of forces, and there is no need to dispose a fixing portion for positioning the lower row of terminals). Said positioning structure is formed by a plurality of bulges 1081 and hollows 1082 surrounded by said bulges 1081 disposed on the fixing portion 108, and said terminals have a plurality of protruding portions 149 corresponding to the plurality of hollows 1082 (obviously, as shown in FIG. 9, the vertical portion of the terminals can be designed with a plurality of cavities corresponding to the plurality of bulges, instead of the protruding portions). Furthermore, each the bulge 1081 has a leading portion 1083 for leading the terminals into the hollows 1082, and the bottom of the insulative body 10 has a recessive portion 109.

Additionally, the base 12 is designed as a ladder, and each step of the ladder has a plurality of passageways 120 for containing the conductive portions of the terminals. Furthermore, in each of the passageway 120 for containing the upper and middle terminals, a rib 121 is disposed in the position within each passageway that corresponds to each hollow 1082; the rib 121 can mate with the hollow 1082 to firmly fix the vertical portion of the terminal in the insulative body 10 and the base 12. Furthermore, the base 12 has a clip portion 122 protruding from the bottom of the base 12, for clasping the recessive portion 109 of the insulative body 10.

In addition, the ground piece 17 includes a body portion 170, a first ground terminal 171 extended and then curved from the body portion 170, and a second ground terminal 172 curved, extended and then curved again from the body portion 170.

Furthermore, the shielding shell 18 formed by stamping of a metal plate. The front end of the shielding shell 18 has a plurality of penetrating holes 180 corresponding to the receiving holes 100 of the insulative body 10, wherein the back end of the shielding shell 18 inwardly protruded to form a plurality of hooks 181 for hooking the base 12, so as to further firmly hook the insulative body 10 and the base 12 within the shielding shell 18. Moreover, ground legs 182 extend from both sides of the bottom of the shielding shell 18.

During assembly, the upper, middle, and lower row of terminals are first disposed in terminal containing holes corresponding to the three receiving holes from back of the insulative body, and body portion 170 of the ground piece 17 is disposed in the ground piece containing channel 105, wherein part of the first ground terminal 171 is disposed in the breach 101, and part of which is extended to the receiving holes 100; furthermore, the second ground terminal 172 is disposed in the gap 104, and part of which is extended outside the gap 104. Afterward, the mounting rings 13 are disposed outside the receiving holes 100, and the base 12 is used to mate with the insulative body 10 to fix the vertical portion of the terminals. Finally, the insulative body 10 is covered with the shielding shell 18, wherein the hooks 181 hook onto the back end of the base 12, so as to fix the insulative body 10 and the base 12 in the shielding shell 18, thus completing the assembly of the electrical connector 1. In detail, when the plug 2 is inserted into the receiving hole 100, the extruding arm 103 can press against the plug 2 and force the plug 2 to move downward to press against the plastic arm 102, and then the plastic arm 102 is forced to move downward to force the third terminal to electrically connect to the forth terminal. Furthermore, the first ground terminal 171 can electrically connect to the plug 2, whereas the second ground terminal 172 can electrically connect to the front of the shielding shell 18, so as to bypass the static electricity between the shielding shell 18 and the plug 2 through the ground leg of the shielding shell 18 to the negative pole of the circuit board (not shown), and then the static electricity is eliminated.

In summary, the electrical connector of the present invention has a fixing portion, for positioning the terminals, between adjacent receiving holes of the insulative body, and it also has a base for cooperating with the positioning structure to firmly fix the terminal in the positioning structure. With the fixing portion, the positioning structure, and the base, the electrical connector of the invention is capable of efficiently fixing the terminals therein, thus ensuring the stability thereof.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and mounteds of the appended claims.

What is claimed is:

1. An electrical connector, comprising:

an insulative body, having at least a receiving hole for insertion of an electrical device, and each receiving hole corresponding to a plurality of terminals; and the plurality of terminals, having a horizontal portion and a vertical portion perpendicular to one another, and the horizontal portion having a contact portion, and the bottom of the vertical portion having a conductive portion;

wherein the insulative body has a fixing portion protruding from an end opposite to the receiving hole, and the fixing portion having a positioning structure, formed by a plurality of bulges and hollows disposed on the fixing portion, for locating the vertical portion of the terminal;

wherein the electrical connector having a base for mating with the positioning structure to fix the terminals in the positioning structure;

wherein the terminals have a plurality of protruding portions corresponding to the plurality of hollows.

2. The electrical connector of claim 1, wherein the terminals has a plurality of cavities corresponding to the plurality of bulges.

3. The electrical connector of claim 1, wherein each bulge has a leading portion for leading the terminals into the hollows.

4. The electrical connector of claim 1, wherein the hollows are surrounded by said bulges, and wherein the base has a plurality of passageways for containing a part of the terminals, and a rib disposed within each passageway corresponding to each hollow.

5. The electrical connector of claim 1, wherein the base has a clip portion protruding therefrom, and the bottom of the insulative body having a recessive portion corresponding to the clip portion.

6. The electrical connector of claim 1, wherein the plurality of terminals in each receiving hole comprise:

a first terminal and a second terminal, for electrically connecting with the electrical device;

a third terminal and a fourth terminal, for electrically connecting each other;

wherein the insulative body has a plastic arm protruding from the receiving hole to force the third terminal to electrically connect to the fourth terminal by conflicting with the electrical device.

7. The electrical connector of claim 1, wherein the insulative body has at least an extruding arm protruding from the receiving hole, and the extruding arm being capable of conflicting with the electrical device.

* * * * *